US009199821B2

(12) United States Patent
Nunokawa et al.

(10) Patent No.: US 9,199,821 B2
(45) Date of Patent: Dec. 1, 2015

(54) RECORDING DEVICE

(71) Applicant: SEIKO EPSON CORPORATION, Tokyo (JP)

(72) Inventors: Yohei Nunokawa, Nagano (JP); Yasuhiko Yoshihisa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/223,118

(22) Filed: Mar. 24, 2014

(65) Prior Publication Data

US 2014/0292879 A1 Oct. 2, 2014

(30) Foreign Application Priority Data

Mar. 27, 2013 (JP) ..... 2013-066640

(51) Int. Cl.

| | |
|---|---|
| ***B65H 3/44*** | (2006.01) |
| ***B65H 5/26*** | (2006.01) |
| ***B65H 39/042*** | (2006.01) |
| ***B65H 1/26*** | (2006.01) |
| ***B41J 11/48*** | (2006.01) |
| ***B41J 13/10*** | (2006.01) |

(52) U.S. Cl.

CPC ..... *B65H 39/042* (2013.01); *B41J 11/485* (2013.01); *B41J 13/103* (2013.01); *B65H 1/266* (2013.01); *B65H 3/44* (2013.01); *B65H 2405/332* (2013.01); *B65H 2405/3322* (2013.01)

(58) Field of Classification Search

CPC ..... B65H 1/00; B65H 1/04; B65H 39/042; B65H 2405/00; B65H 2405/11; B65H 2405/33; B65H 2405/332; B65H 2405/3321; B65H 2405/3322; B65H 3/44; B65H 1/26; B65H 1/266; B65H 1/08; B41J 11/485; B41J 13/103

USPC ..... 271/9.11, 147, 164, 9.08

See application file for complete search history.

(56) References Cited

U.S. PATENT DOCUMENTS

| | | | | |
|---|---|---|---|---|
| 7,887,038 | B2 * | 2/2011 | Shigeno et al. | 271/9.08 |
| 2005/0258586 | A1 | 11/2005 | Elenes et al. | |
| 2006/0262355 | A1 * | 11/2006 | Kurata et al. | 358/305 |
| 2008/0296831 | A1 * | 12/2008 | Chino | 271/145 |
| 2012/0175838 | A1 * | 7/2012 | Nakamura et al. | 271/9.11 |
| 2013/0001856 | A1 * | 1/2013 | Uchida | 271/9.11 |
| 2013/0221600 | A1 * | 8/2013 | Kotaka et al. | 271/9.08 |
| 2014/0021677 | A1 * | 1/2014 | Nunokawa et al. | 271/9.08 |
| 2014/0291913 | A1 * | 10/2014 | Tamura et al. | 271/9.03 |

FOREIGN PATENT DOCUMENTS

| | | | | |
|---|---|---|---|---|
| DE | 3219784 | A1 * | 12/1982 | B65H 1/04 |
| JP | 2005-330105 | A | 12/2005 | |

* cited by examiner

*Primary Examiner* — Prasad Gokhale

(74) *Attorney, Agent, or Firm* — Global IP Counselors, LLP

(57) ABSTRACT

An upper cassette for which a media feed direction length is shorter than that of a lower cassette is provided movably in a medium feed direction to a device main unit. When the upper cassette is not moving, and when the upper cassette is not in a feed state, if the upper cassette is at a position further to a side of a feed position than a removal position, the upper cassette is moved to the removal position.

12 Claims, 8 Drawing Sheets

RECORDING DEVICE

CROSS-REFERENCE TO RELATED APPLICATIONS

This application claims priority to Japanese Patent Application No. 2013-066640 filed on Mar. 27, 2013. The entire disclosure of Japanese Patent Application No. 2013-066640 is hereby incorporated herein by reference.

BACKGROUND

1. Technical Field

The present invention relates to a recording device for which a plurality of detachable medium housing units capable of housing a medium fed for recording are detachably provided on a device main unit.

2. Related Art

In Unexamined Patent Publication No. 2005-330105, for example, disclosed is a system equipped with two levels of feed trays (medium housing units), upper and lower, that are independently detachable and supply paper to this kind of recording device. The medium feed direction length of the upper side first tray (second medium housing unit) is shorter than that of the lower side second tray (first medium housing unit), and this first tray moves automatically between the pick position (feed position) and the loading position (removal position). In more detail, this system is equipped with a first tray for holding a first supply source of paper, a first mechanism for sending paper from the first tray to the device by a shaft rotating in a first direction, and a second mechanism for moving the first tray from the pick position to the loading position by a shaft rotating in a second direction.

With this type of device, when the upper layer first tray is at the inward feed position inside the device main unit, it is difficult for the user to remove the first tray. However, with the system noted above, when the first tray is empty, or photographic printing based on a print job has ended, the constitution is such that a driver automatically returns the first tray from the pick position to the loading position. Because of this, when the first medium housing unit becomes empty, and when photographic printing has ended, the user is able to remove the first medium housing unit relatively easily, and for example is able to refill photographic paper or replace with another type of paper in the first tray.

However, with the technology noted in Unexamined Patent Publication No. 2005-330105, when the first tray is empty, or photographic printing has ended, even when the first tray is automatically moved from the pick position, before removing the first tray, there are cases when the user mistakenly pushes the first tray for some reason, and the first tray is moved further inward than the loading position.

For example, the user houses the paper discharging tray that was in an extended state during printing after printing ends, or houses the paper discharging tray at a position to a degree for which it will not be an obstruction before removing the first tray. However, when the user pushes the paper discharging tray to house it, if he mistakenly pushes the first tray which is underneath relatively close to the paper discharging tray, the first tray will end up being moved further inward than the loading position. When the first tray is in a position moved further to the pick position side than the loading position in this way, there is the problem that it is difficult to remove the first tray. This problem also applies in common with recording devices constituted so that at least one of a plurality of medium housing units provided to be detachable on the device main unit can move between the removal position and the feed position.

SUMMARY

The present invention was created to address the problems noted above, and an object is to provide a recording device for which it is possible to remove the second medium housing unit from the removal position even when the second medium housing unit is mistakenly pushed to the feed position side after the second medium housing unit is moved from the feed position to the removal position after recording based on a recording job ends.

The recording device to address the problems noted above is equipped with a first medium housing unit configured to house a medium, a second medium housing unit configured to house the medium and for which a medium feed direction length is shorter than the of the first medium housing unit, a feed unit provided in common for the first medium housing unit and the second medium housing unit, for feeding the medium from one of that first and second medium housing units, a drive unit configured to move the second medium housing unit between a feed position that allows the feed unit to feed, and a removal position that allows removal of the second medium housing unit from a device main unit, a conveyance unit configured to convey the medium fed by the feed unit, a recording unit configured to perform recording on conveyed medium based on a recording job, and a control unit configured to drive the drive unit to move the second medium housing unit to the removal position if the second medium housing unit is positioned further to a side of the feed position than the removal position when the second medium housing unit is not moving, and when the second medium housing unit is not in a feed state.

With this constitution, if the second medium housing unit is positioned further to the feed position side than the removal position when the second medium housing unit is not moving, and when not in a feed state from the second medium housing unit, the control unit drives the drive unit and moves the second medium housing unit to the removal position. Thus, even if the user mistakenly pushes the second medium housing unit that is in the attached position to the feed position side, control is used to return the second medium housing unit to the removal position, so the user is able to relatively easily remove the second medium housing unit from the device main unit.

With the recording device noted above, it is preferable that the recording device further comprises a stacker configured to stack the medium recorded by the recording unit and discharged, and move between a housing position housed in a device main unit and a projecting position projecting from the device main unit when stacking the medium, a first detection unit configured to detect that the second medium housing unit is in the removal position, and a second detection unit configured to detect that the stacker is further to a side of the housing position than a designated position which is a position for which a projecting length is shorter than that of the projecting position, and that the control unit drive the drive unit and move the second medium housing unit to the removal position based on the detection results of the first detection unit and the second detection unit, then the second medium housing unit is positioned further to the side of the feed position than the removal position, and the stacker is positioned further to the side of the housing position than the designated position.

With this constitution, the control unit drives the drive unit and moves the second medium housing unit to the removal position when, based on the detection results of the first detection unit and the second detection unit, the second medium housing unit is positioned further to the feed position side than the removal position, and the stacker is positioned further to the housing position side than the designated position. Specifically, when the stacker is positioned further to the housing position side than the designated position, and the projecting volume is small to the level that recording is regarded as not being performed, control is used to move the second medium housing unit to the removal position. Thus, even if the user mistakenly pushes the second medium housing unit that is in the attached position to inside the device main unit, control is used to return the second medium housing unit to the removal position, so it is possible to relatively easily remove the second medium housing unit from the device main unit.

With the recording device noted above, it is preferable that the second detection unit detects that the stacker is in the housing position, and the control unit drives the drive unit and moves the second medium housing unit to the removal position when the second medium housing unit is positioned further to the side of the feed position than the removal position, and the stacker is in the housing position.

With this constitution, the control unit drives the drive unit and moves the second medium housing unit to the removal position when the second medium housing unit is positioned further to the feed position side than the removal position, and the stacker is in the housing position. Thus, even if the user mistakenly pushes the second medium housing unit in the attached position to inside the device main unit, control is used to return the second medium housing unit to the removal position, so it is possible to relatively easily remove the second medium housing unit from the device main unit.

With the recording device noted above, it is preferable that when there is no next recording job after a current recording job by the recording unit ends in a state with the second medium housing unit arranged in the feed position, the control unit waits until a standby time has elapsed, and when the standby time has elapsed, the control unit moves the second medium housing unit to the removal position.

With this constitution, when there is no next recording job after the current recording job by the recording unit ends in a state with the second medium housing unit arranged in the feed position, the control unit waits until the standby time has elapsed. During this standby, the second medium housing unit is held in the feed position. Because of this, if there is a next recording job that uses the second medium housing unit as the feed source within the standby time, it is possible to start feeding the medium immediately from the second medium housing unit in the feed position.

With the recording device noted above, it is preferable that during recording on a medium using the first medium housing unit as the feed source, if the second medium housing unit is positioned further to the side of the feed position than the removal position, the control unit moves the second medium housing unit to the removal position.

With this constitution, during recording on a medium using the first medium housing unit as the feed source, if the second medium housing unit is positioned further to the feed position side than the removal position, the control unit moves the second medium housing unit to the removal position. For example, during recording with the first medium housing unit as the feed source, even if the user trying to remove the second medium housing unit mistakenly pushes the second medium housing unit to the feed position side, control is used to return the second medium housing unit to the removal position, so it is possible to relatively easily remove the second medium housing unit from the device main unit.

With the recording device noted above, it is preferable that during at least one of a time of power on operation detection, a time of power off operation detection, and a time when shifting to power saving mode, the control unit moves the second medium housing unit to the removal position.

With this constitution, during at least one of the time of power on operation detection, the time of power off operation detection, and the time when shifting to power saving mode, the control unit moves the second medium housing unit to the removal position. During these times, thereafter, there is a high possibility of the user refilling or replacing the medium in the second medium housing unit, and at that time, the user is able to relatively easily remove the second medium housing unit from the device main unit.

With the recording device noted above, it is preferable that when in the power saving mode, when the second medium housing unit is detected to have moved to the feed side from the removal position, the control unit cancels the power saving mode, drives the drive unit, and moves the second medium housing unit to the removal position.

With this constitution, when during the power saving mode, the user mistakenly who is trying to refill medium in the second medium housing unit or the like mistakenly pushes the second medium housing unit into the device main unit, the power saving mode is cancelled, and control is used to return the second medium housing unit to the removal position, so it is possible to refill or replace the medium in the second housing unit.

BRIEF DESCRIPTION OF THE DRAWINGS

Referring now to the attached drawings which form a part of this original disclosure.

DETAILED DESCRIPTION OF EXEMPLARY EMBODIMENTS

Following, an embodiment with a specific example of a printer which is one example of a recording device will be described based on FIG. 1 through FIG. 9.

Figure 1:
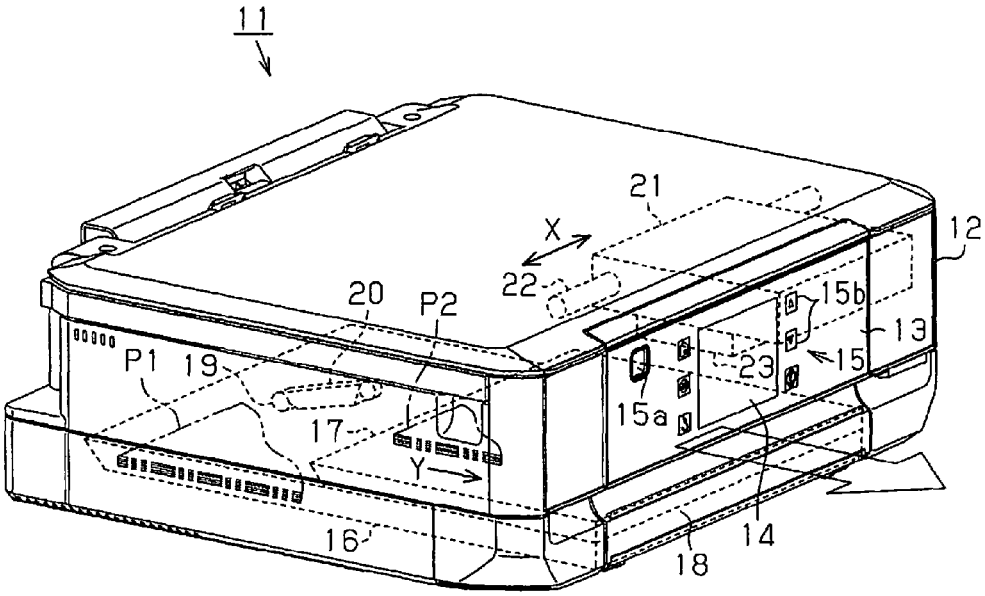
FIG. 1 is a perspective view of a printer of a first embodiment.

As shown in FIG. 1, the printer 11 is equipped with a device main unit 12 having a thin, roughly rectangular solid shape, and an operating panel 13 used for the user input operation provided on the front surface of the device main unit 12 (right surface in FIG. 1). Provided on the operating panel 13 are a display unit 14 consisting of a liquid crystal panel or the like, and an operating unit 15 consisting of a plurality of operating switches. The operating unit 15 includes a power switch 15*a* for doing on and off operations for the power supply of the printer 11, and a selection switch 15*b* for doing a selection operation of the desired selection item on a menu screen displayed on the display unit 14.

As shown in FIG. 1, at the lower side position of the operating panel 13 on the front surface of the device main unit 12, two layer feed cassettes, upper and lower, 16 and 17 capable of housing a plurality of sheets of paper P as an example of a medium are mounted in a state capable of being independently attached and detached (insertable and removable). Of the two feed cassettes 16 and 17, the feed cassette arranged at the lower side (hereafter also called "lower cassette 16") is equipped with a cover 18 that can open and close with the bottom end part as a rotation axis on its front surface side (right surface in FIG. 1), and each cover 18 can be pulled out. Also, of the two feed cassettes 16 and 17, the feed cassette arranged at the top side (hereafter also called "upper cassette 17") is mounted in a state for which in a state with the lower cassette 16 mounted, for example, it can be attached and detached in a mounting port exposed by opening the cover 18. With this embodiment, one example of the first medium housing unit is constituted by the lower cassette 16, and one example of the second medium housing unit is constituted by the upper cassette 17.

With this embodiment, the lower cassette 16 is able to house paper P1 of a relatively large paper size. This lower cassette 16 has a slightly shorter length than the full length (depth direction length) of the printer 11 in the conveyance direction Y, and has a slightly longer width than the maximum paper width in the width direction X. Meanwhile, the upper cassette 17 is able to house paper P2 of relatively small paper size. This upper cassette 17 has a length shorter than the full length of the lower cassette 16 in the conveyance direction Y, and has a width that is almost the same as the lower cassette 16 in the width direction X. With this example, the length of the upper cassette 17 in the conveyance direction Y is approximately ⅔ of the length of the lower cassette 16 in the conveyance direction Y. Of course, the ratio of the length in the conveyance direction Y of the lower cassette 16 and the upper cassette 17 can be set to a value as one thinks appropriate as long as upper cassette 17 is shorter.

The upper cassette 17 of this embodiment is electrically operated and able to move back and forth in a direction parallel to the conveyance direction Y, and as shown in FIG. 1, can move between a removal position (loading position) for which the front surface is positioned at a position just to the back surface side of the cover 18 in the closed position for which detachment by the user is possible, and a feed position positioned to the inner side (left side in FIG. 1) by a designated distance from this removal position toward inside the device main unit 12. Thus, if the user opens the cover 18 in a state with the upper cassette 17 arranged at the removal position, it is possible to pull out the upper cassette 17. In contrast to this, for example, in a state with the upper cassette 17 arranged at the feed position positioned in the depth direction inside the device main unit 12, the user cannot grasp the upper cassette 17, so removing the upper cassette 17 is very difficult.

As shown in FIG. 1, inside the device main unit 12, at a position to the depth side of the width center part of the cassettes 16 and 17, a pickup roller 19 (also see FIG. 3) is arranged in a state supported to be rotatable on the tip part of an oscillating member 20. One of this pickup roller 19 is provided in common for the lower cassette 16 and the upper cassette 17. With this embodiment, an example of a feed unit is constituted using the pickup roller 19 and the oscillating member 20, or the like.

When the upper cassette 17 is in the removal position, the oscillating member 20 tilts so that its tip part moves downward, and the pickup roller 19 abuts the top surface of the paper P1 housed in the lower cassette 16. In this state, by the pickup roller 19 rotating, the topmost one sheet of paper P1 is fed from the lower cassette 16 to the feed direction downstream side. Also, when the upper cassette 17 is in the feed position, the oscillating member 20 is pushed up by the upper cassette 17, and the pickup roller 19 abuts the topmost one sheet of paper P2 housed inside the upper cassette 17. In this state, by the pickup roller 19 rotating, the topmost one sheet of paper P2 is fed from the upper cassette 17 to the feed direction downstream side. The paper P fed from one of the cassettes 16 and 17 is conveyed in the conveyance direction Y along a designated conveyance path while turning around at the back part inside the device main unit 12. With this specification, the paper housed in the lower cassette 16 is marked with code number "P1," and the paper housed in the upper cassette 17 is marked with code number "P2," but when it is not particularly necessary to distinguish between the cassette that the paper is housed in, this is simply noted as "paper P."

As shown in FIG. 1, inside the device main unit 12, the carriage 21 is provided in a state that can move back and forth along the main scanning direction X guided by a guide axis 22 constructed so as to extend in the main scanning direction X (with this example, the width direction) intersecting the conveyance direction Y. On the bottom part of the carriage 21, a recording head 23 having a plurality of nozzles that spray ink drops on the conveyed paper P is attached. The already printed paper P is exhausted in the direction shown by the white outline arrow in FIG. 1 from an exhaust port that is exposed in a state with the cover 18 open. The exhausted already printed paper P is placed on a paper discharging stacker 24 (paper discharging tray) (see FIG. 4) arranged in a state provided projecting so as to be able to go in and out from below the exhaust port of the front side of the device main unit 12 toward the front.

Figure 2:
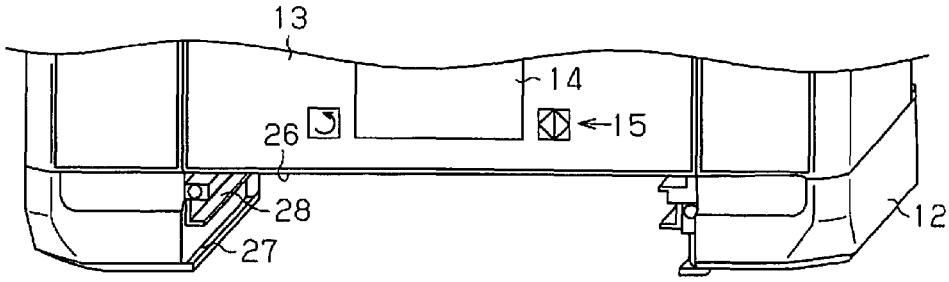
FIG. 2 is a partial perspective view of the printer showing a periphery of a housing recess in which a feed cassette is attached and detached.

As shown in FIG. 2, on the bottom side of the operating panel 13 with the device main unit 12, a cassette housing recess 26 for mounting the cassettes 16 and 17 is provided indented so as to extend along the inward direction. On the left and right inner wall part of the cassette housing recess 26 of the device main unit 12, a bottom guide rail 27 that guides the lower cassette 16 in the attaching/detaching direction as well as supports it, and a top guide rail 28 that guides the upper cassette 17 in the attaching/detaching direction as well as supports it are provided. In this way, the lower cassette 16 is able to be mounted in and removed from the cassette housing recess 26 by moving in the attaching/detaching direction guided on the bottom guide rail 27. Also, the upper cassette 17 is able to be mounted on and removed from the cassette housing recess 26 by moving in the attaching/detaching direction guided by the top guide rail 28. However, when the upper cassette 17 is mounted, it is normally arranged at the removal position without reaching the feed position. Then, the upper cassette 17 mounted in the removal position moves by electric power between the removal position and the feed position along the top guide rail 28. The detailed constitution of a feed mechanism including the cassettes 16 and 17, the pickup roller 19 and the like will be described later.

Figure 3:
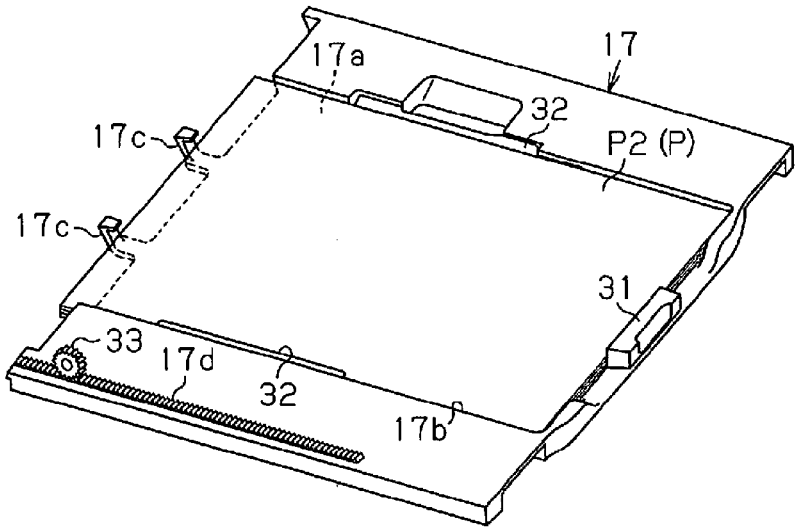
FIG. 3 is a perspective view showing an upper cassette and a lower cassette.
Figure 3:
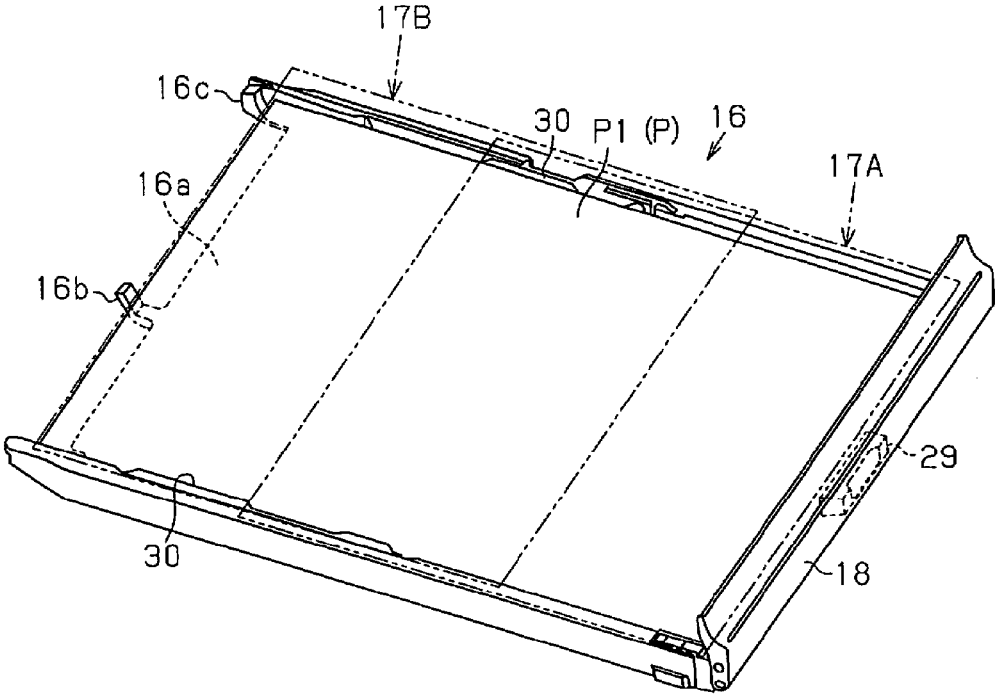

Next, the constitution of the cassettes 16 and 17 will be described. As shown in FIG. 3, the lower cassette 16 has a bottom surface 16*a* on which the paper P1 can be placed, and on the end part position of the cover 18 side of this bottom surface 16*a* is provided an edge guide 29 that can slide in the paper feed direction (reverse conveyance direction Y) and that restricts the back end edge position of the paper P. Also, on the lower cassette 16, provided is a pair of edge guides 30 that can slide in the paper width direction (same as width direction X in FIG. 1) that intersects with the paper feed direction, and that restricts the side edge position of the paper P1. With this embodiment, the paper inside the lower cassette 16 has its width center guided to a center position matching the width center of the lower cassette 16.

Also, at the mounting direction tip part of the lower cassette 16 (left edge part in FIG. 3), a stopper 16*b* that restricts the tip edge of the set paper P1 is provided, and furthermore, provided on the tip part of the lower cassette 16 is a pressing part 16*c* which, in the process of mounting the lower cassette 16 in the device main unit 12, engages with the oscillating member 20 holding mechanism (not illustrated), and that hold can be cancelled. By cancelling the holding mechanism of the oscillating member 20, the pickup roller 19 drops and abuts the paper P1 inside the lower cassette 16.

Meanwhile, as shown in FIG. 3, the upper cassette 17 is equipped with a housing recess 17*b* having a bottom surface 17*a* on which paper P2 can be placed. On the edge part of the cassette mounting direction front side (right edge part in FIG. 3) with this bottom surface 17*a*, an edge guide 31 that can slide in the paper feed direction is provided. Also, a pair of edge guides 32 that can restrict the position from both sides of the side edge of the paper P2 that has slid in the paper width direction is provided in the housing recess 17*b*. With this embodiment, the paper P2 inside the upper cassette 17 is guided to a center position in the width direction of the upper cassette 17 by the pair of edge guides 32.

Also, at the mounting direction tip edge part (left edge part in FIG. 3) with the upper cassette 17, a stopper 17*c* that restricts the paper edge position is provided, and the constitution is such that with this stopper 17*c*, the paper P2 set in the upper cassette 17 does not fly out from the upper cassette 17. In the process of moving the upper cassette 17 from the removal position to the feed position, the stopper 17*c* engages with the oscillating member 20 and pushes the oscillating member 20 upward, and in a state with the upper cassette 17 in the feed position, the pickup roller 19 abuts the paper P2 inside the upper cassette 17.

Figure 4:
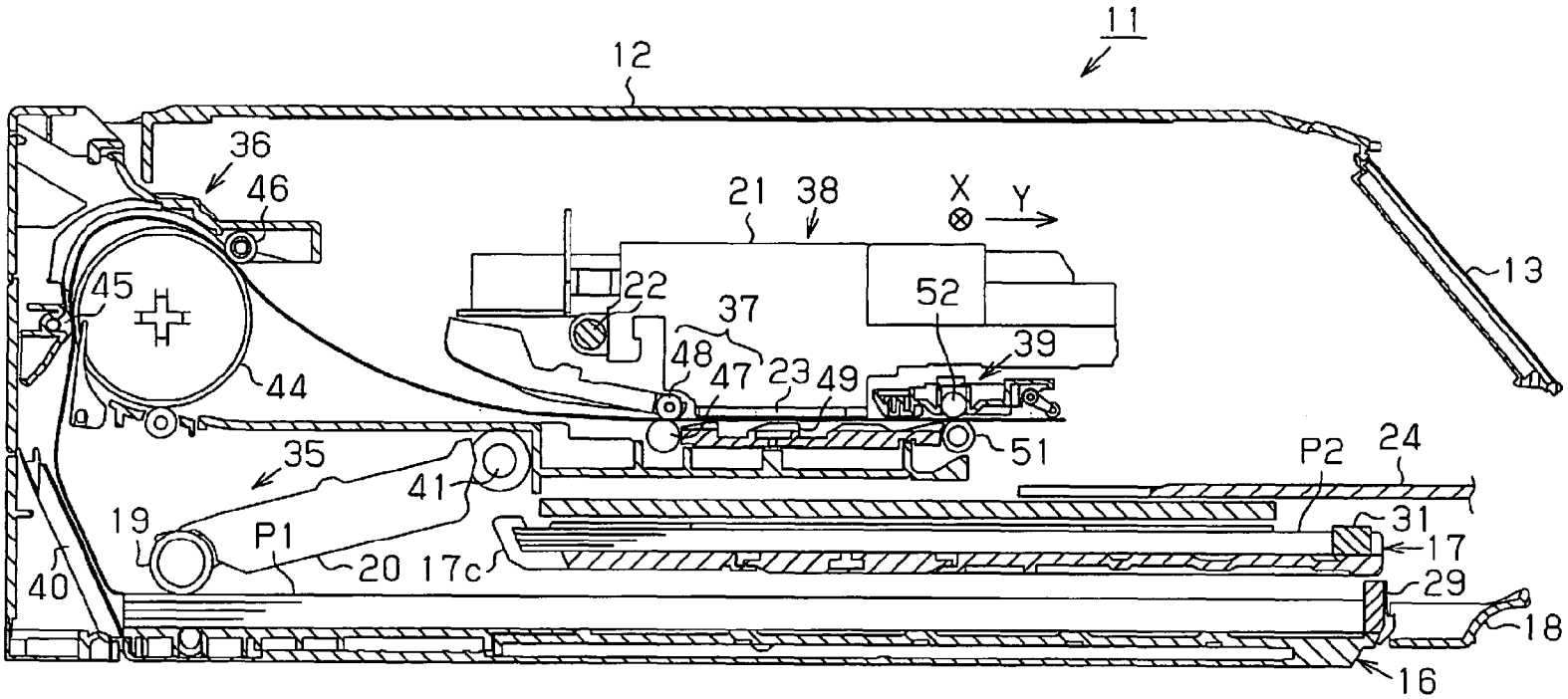
FIG. 4 is a typical side cross section view of the printer when the upper cassette is in a removal position.
Figure 5:
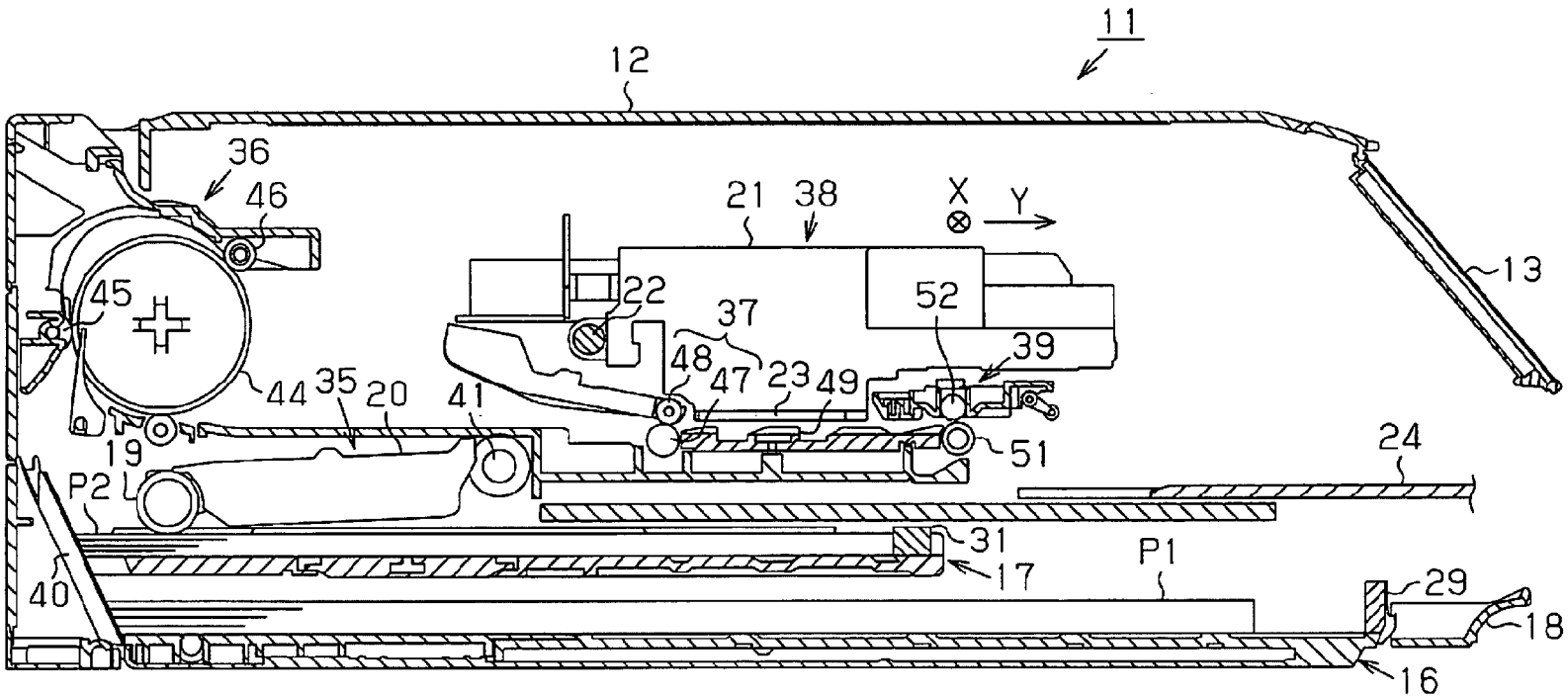
FIG. 5 is a typical side cross section view of the printer when the upper cassette is in a feed position.

Also, as shown in FIG. 3, a rack unit 17*d* of a designated length is formed extending along the sliding direction (paper feed direction) on one edge part top surface in the width direction of the upper cassette 17. A rack and pinion mechanism is constituted by a pinion gear 33 engaging with this rack unit 17*d*. By the engaging position of the pinion gear 33 and the rack unit 17*d* being changed by the rotation pinion gear 33 being rotated by the force of the conveyance motor 43 (see FIG. 6) which is the power source of the conveyance system that conveys the paper P, the upper cassette 17 slides between the removal position (retraction position: FIG. 4) of the double dot-dash line shown as code 17A in FIG. 3, and similarly the feed position (end position: FIG. 5) of the double dot-dash line shown as code 17B.

Next, the detailed constitution of the printer 11 will be described using FIG. 4 and FIG. 5. As shown in FIG. 4 and FIG. 5, the device main unit 12 is equipped with a cassette feed unit 35, a medium feed unit 36, a medium conveyance unit 37, a recording unit 38, and a forwarding unit 39. The cassette feed unit 35 is equipped with the lower cassette 16, the upper cassette 17, the pickup roller 19, and a separation unit 40 provided at a position facing the edge of the paper P housed in each cassette 16 and 17.

The lower cassette 16 and the upper cassette 17 provided above that are respectively able to house a plurality of sheets of paper P1 and P2, and can respectively be independently attached and detached with the device main unit 12. Also, even if one of the two cassettes 16 and 17 is in an unmounted state, as long as the other is mounted, it is possible to feed paper P from that mounted cassette. The upper cassette 17 slides and is displaced between the removal position (FIG. 4) and the feed position (FIG. 5) by the force of the conveyance motor 43 (see FIG. 6).

As shown in FIG. 4 and FIG. 5, the pickup roller 19 is attached in a state able to rotate on the tip part of an oscillating member 20 supported to be able to oscillate with an oscillating shaft 41 as the center on the support frame (not illustrated) inside the device main unit 12. The pickup roller 19 is rotated and driven by transmission of the force of the conveyance motor 43 via the train of gears inside the oscillating member 20. The oscillating member 20 is equipped with a holding mechanism (not illustrated) provided at a position capable of engagement with the pressing part 16*c* of the lower cassette 16 and capable of holding the pickup roller 19 at the center position, and a cam follower (not illustrated) provided at a position capable of engagement with the stopper 17*c* of the upper cassette 17.

When midway in the insertion of the lower cassette 16 into the device main unit 12, the pressing part 16*c* of the tip part engages with the holding mechanism (not illustrated), and holding of the pickup roller 19 by the holding mechanism is released, the pickup roller 19 drops to the position at which it contacts the paper P1 inside the lower cassette 16. Because of this, when the upper cassette 17 is at the removal position (retraction position) shown in FIG. 4, the pickup roller 19 abuts the topmost one sheet of paper P1 inside the lower cassette 16, and when the pickup roller 19 is rotated by the drive of the conveyance motor 43 in this state, the topmost paper P1 is fed from the lower cassette 16 to the feed path downstream side.

Also, in the process of moving the upper cassette 17 from the removal position (FIG. 4) to the feed position (FIG. 5), the stopper 17*c* (see FIG. 3 and FIG. 4) of the tip part engages with the cam follower (not illustrated) of the oscillating member 20, and pushes the oscillating member 20 upward. Furthermore, when the upper cassette 17 enters toward the feed position, when the engagement of the stopper 17*c* and the cam follower is released, the pickup roller 19 drops to the position at which it contacts the paper P2 inside the upper cassette 17 (FIG. 5). Because of this, as shown in FIG. 5, when the upper cassette 17 is in the feed position, the pickup roller 19 abuts the topmost sheet of the paper P2 inside the upper cassette 17. When the pickup roller 19 is rotated by the conveyance motor 43 being driven in this state, the topmost paper P2 is fed. Also, the topmost paper P fed from one of the cassettes 16 and 17 is separated from the paper P of the second place item and thereafter by the separation unit 40.

As shown in FIG. 4 and FIG. 5, the medium feed unit 36 provided on the feed path downstream side of the separation unit 40 is equipped with a feed drive roller 44 driven by the conveyance motor 43, a separation roller 45, and a feed driven roller 46. The separation roller 45 performs separation on the paper P again together with contact with the feed drive roller 44, and reliably sends only the topmost paper P to the feed path downstream side.

Also, the paper P sandwiched between the feed drive roller 44 and the feed driven roller 46 is conveyed to the medium conveyance unit 37. The medium conveyance unit 37 is similarly equipped with a conveyance drive roller 47 driven by the conveyance motor 43, and a conveyance driven roller 48 that presses and contacts the conveyance drive roller 47 and follows its rotation. The paper P is sent further to the downstream side by this medium conveyance unit 37.

As shown in FIG. 4 and FIG. 5, the recording unit 38 provided on the downstream side of the conveyance direction Y of the medium conveyance unit 37 is equipped with the carriage 21, the recording head 23, and a support platform 49 facing opposite the recording head 23. The recording head 23 provided in a state facing opposite the paper P at the bottom part of the carriage 21 prints an image on the paper P by spraying ink drops on the paper P supported on the platform 49 in the process of the carriage 21 moving back and forth in the main scanning direction X (direction orthogonal to the paper surface in FIG. 4 and FIG. 5) while being guided by the guide axis 22 by the force of the carriage motor 50 (see FIG. 6).

The forwarding unit 39 provided at the downstream side of the support platform 49 is equipped with a first roller 51 driven by the conveyance motor 43 and a second roller 52 that contacts the first roller 51 and rotates following that. The paper P after printing fed to the downstream side of the conveyance direction Y by the forwarding unit 39 is placed on the paper discharging stacker 24 (one example of a stacker) slid to outside the device main unit 12 (front surface side). With this embodiment, one example of the conveyance unit is constituted by the medium feed unit 36, the medium conveyance unit 37, and the forwarding unit 39.

Figure 6:
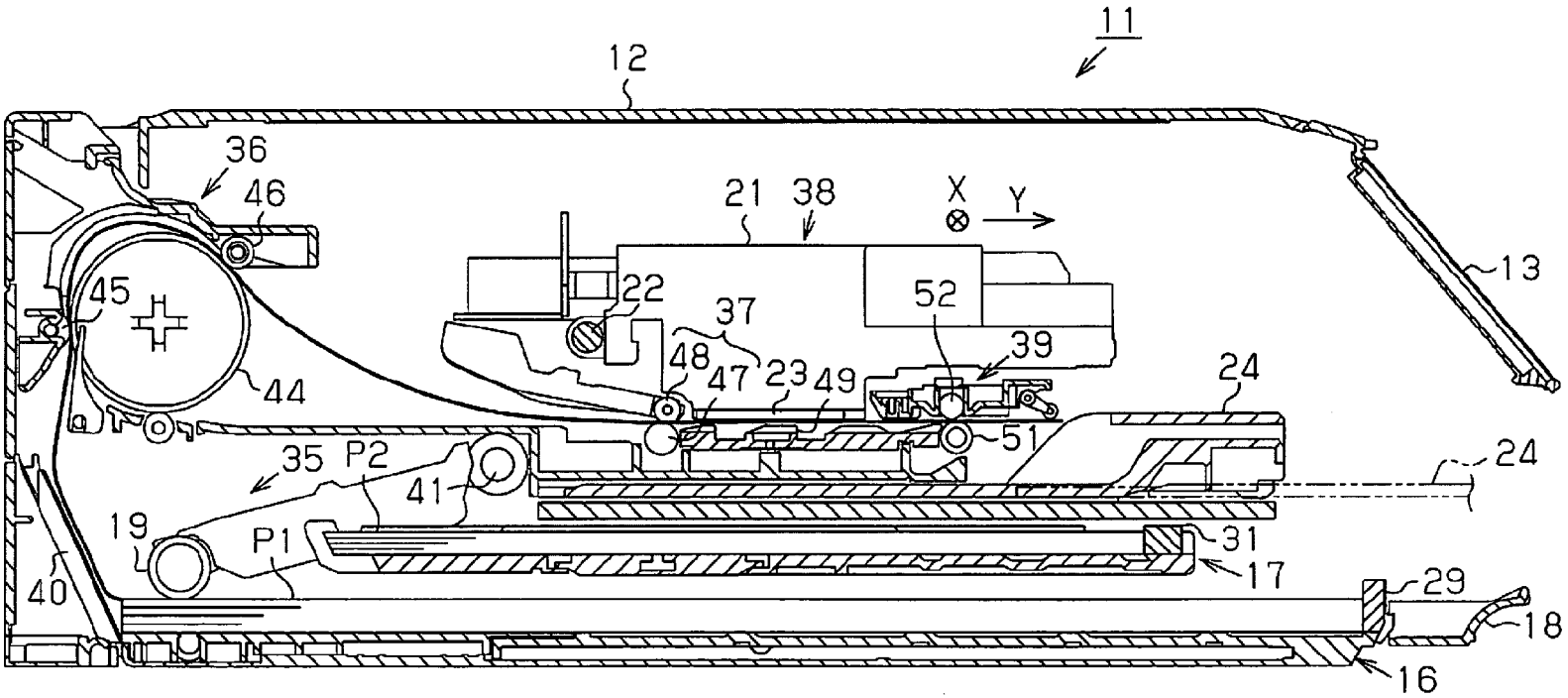
FIG. 6 is a typical side cross section view of the printer when the upper cassette is displaced to a feed position side from the removal position.

As shown in FIG. 4 to FIG. 6, the paper discharging stacker 24 (hereafter also simply referred to as "stacker 24") is constituted by one roughly square plate shaped tray. The stacker 24 is electrically operated and is driven by the force of an electric motor 55 (see FIG. 7), and is able to move back and forth between a closed position housed inside the device main unit 12 (housing position) (e.g. the state in FIG. 6) and an open position projecting by a designated projection length (maximum projection length) from the device main unit 12 (projecting position) (e.g. the state in FIG. 4 and FIG. 5).

A pair of racks 56 is formed extending along the movement direction (same as the paper discharging direction Y) at both width direction edge parts of the top surface of the stacker 24 (medium receiving surface), and a pair of pinion gears 57 (see FIG. 7 for both) fit and attached to a rotation shaft (not illustrated) that can be rotated by the power of the electric motor 55 being transmitted to the pair of racks 56 are respectively engaged. By the electric motor 55 being driven forward, the stacker 24 is moved in the projecting direction facing from the closed position to the open position.

The constitution is such that the housing of the stacker 24 from the open position to the closed position is performed manually by the user.

The operating panel 13 and the stacker 24 shown in FIG. 4 to FIG. 6 are driven by the power of a shared electric motor 55 (shown in FIG. 7), in tandem with the stacker 24 moving from the closed position to the projection position, the operating panel 13 rotates forward from the closed position, and as shown in FIG. 4 to FIG. 6, is arranged in an orientation of a designated angle that is easy for the user to see. At this time, the cover 18 is pressed in resistance to the biasing force of a spring (not illustrated) by the stacker 24 during movement in the projecting direction, and as shown in FIG. 4 to FIG. 6, by the cover 18 tilting forward, the exhaust port is opened, and also the front surfaces of the cassettes 16 and 17 are exposed and the cassettes 16 and 17 can be attached and detached by the user. With this embodiment, the movement of the operating panel from the open position to the closed position is performed by the user operating a lock release button, for example.

When the power is turned on, the stacker 24 moves from the closed position to the open position. When a print job is received, the printer 11 performs the printing operation based on the print job, and the paper P after printing is placed on the stacker 24. When printing ends, the user pushes the stacker 24 and houses it inside the device main unit 12. Also, when refilling the paper or replacing it with an item of another paper type or paper size, normally, the user removes the upper cassette 17 after pushing the stacker 24 projecting at the top side of the upper cassette 17 and housing it. If the user's hand mistakenly touches the upper cassette 17 when pushing the stacker 24 to the housing position side, as shown in FIG. 6, there are cases when the upper cassette 17 is pushed inside the device main unit 12 further to the inside than the removal position. In this case, the front edge part of the upper cassette 17 (the right edge part in FIG. 6) is positioned at the back surface side of the stacker 24 that is in the closed position further to the inside than the front edge part, so it is difficult for the user to remove the upper cassette 17.

With this embodiment, when the upper cassette 17 which was originally supposed to be arranged in the removal position is positioned further to the feed position side than the removal position due to some reason such as the user mistakenly pushing it, control is performed to return the upper cassette 17 to the removal position, and the upper cassette 17 is returned to the removal position shown in FIG. 4.

Next, the electrical configuration of the printer 11 will be described.

As shown in FIG. 6, the printer 11 is equipped with a controller 60 as an example of a control unit in charge of the various controls. The controller 60 is connected to be able to communicate with a host device 100 via a communication interface 61. The controller 60 controls the printing operation and the like of the printer 11 based on the print job data received from the host device 100. The host device 100 consists of a personal computer or the like, and has a built in printer driver 101. The host device 100 is equipped with an input unit 102 consisting of a keyboard and mouse, and by the user operating the input unit 102, he inputs printing condition information on the setting screen displayed by the printer driver 101 on a monitor (not illustrated). The printing condition information includes paper type, paper size, print color, print quality and the like. The printer driver 101 generates print image data according to the printing condition information, and sends to the printer 11 print job data generated with a header attached that includes a portion of the printing condition information. With this example, the header includes information necessary for specifying which one of the cassettes 16 and 17 will be the paper feed source (examples include paper type and paper size) or the like. In addition to being a personal computer, the host device 100 can also be a mobile terminal (smart phone or the like).

As an output system, the display unit 14, the carriage motor 50, and the conveyance motor 43 are connected to the controller 60. Also connected to the controller 60 as the input system are the operating unit 15 that includes the power switch 15*a*, a linear encoder 62, encoders 63 and 67 (e.g. a rotary encoder), a paper detection sensor 64, a first sensor 65 as an example of first detection units, a second sensor 66, and closed sensor 68 and open sensor 69 constituting an example of a second detection unit.

As shown in FIG. 6, the controller 60 is equipped with a computer 70, a display driver 71, a head driver 72, and motor drivers 73 to 75. The computer 70 drives the recording head 23 via the head driver 72 based on print job data (hereafter also simply called "print job"), and draws an image or the like on the paper P based on the print image data by spraying ink drops. Also, the computer 70 drives and controls the carriage motor 50 via the motor driver 73, and controls movement of the carriage 21 in the main scanning direction X. At this time, the computer 70 grasps the movement position with the home position of the carriage 21 as the origin point, for example, by calculating the input pulses from the linear encoder 62 using a counter (not illustrated). With this embodiment, one example of a recording job is constituted by a print job.

Furthermore, the computer 70 drives and controls the conveyance motor 43 via the motor driver 74. Here, a power transmission switching unit 76 (clutch unit) is interposed on the power transmission path by which the power of the conveyance motor 43 is transmitted. The power transmission switching unit 76 has a switching lever (not illustrated) arranged on the movement path of the carriage 21, and in a state with the carriage 21 pressing the switching lever, is switched to a switching position according to the rotation position by the conveyance motor 43 being driven by a designated rotation volume. The conveyance motor 43 is always connected with the feed drive roller 44, the conveyance driver roller 47, and the first roller 51. By the switching position of the power transmission switching unit 76 being selected, the transmission destination of power from the conveyance motor 43 is respectively switched to the upper cassette 17, the pickup roller 19 or the like.

In a state with the power transmission switching unit 76 in the cassette switching position shown in FIG. 6, when the conveyance motor 43 is rotated in the normal direction, the pinion gear 33 (see FIG. 3) rotates in the normal direction, and via the engagement of this normal rotation pinion gear 33 and the rack unit 17*d*, the upper cassette 17 moves in the direction from the removal position inside the device main unit 12 toward the feed position. Meanwhile, when the conveyance motor 43 is driven to rotate in the reverse direction, the pinion gear 33 rotates in reverse, and via the engagement of this reverse rotating pinion gear 33 and the rack unit 17*d*, the upper cassette 17 moves in the direction from the feed position inside the device main unit 12 toward the removal direction.

The encoder 63 outputs to the computer 70 a detection pulse signal having a number of pulses proportional to the rotation volume of the conveyance motor 43. Also, the first sensor 65 turns on when the upper cassette 17 is in a state in the removal position (FIG. 4), and is off when not in the removal position. Also, the second sensor 66 is on in a state with the upper cassette 17 in the feed position (FIG. 5), and is off when not in the feed position. With this embodiment, an example of the drive unit is constituted by the conveyance motor 43 for driving the upper cassette 17 and the motor driver 74.

Figure 7:
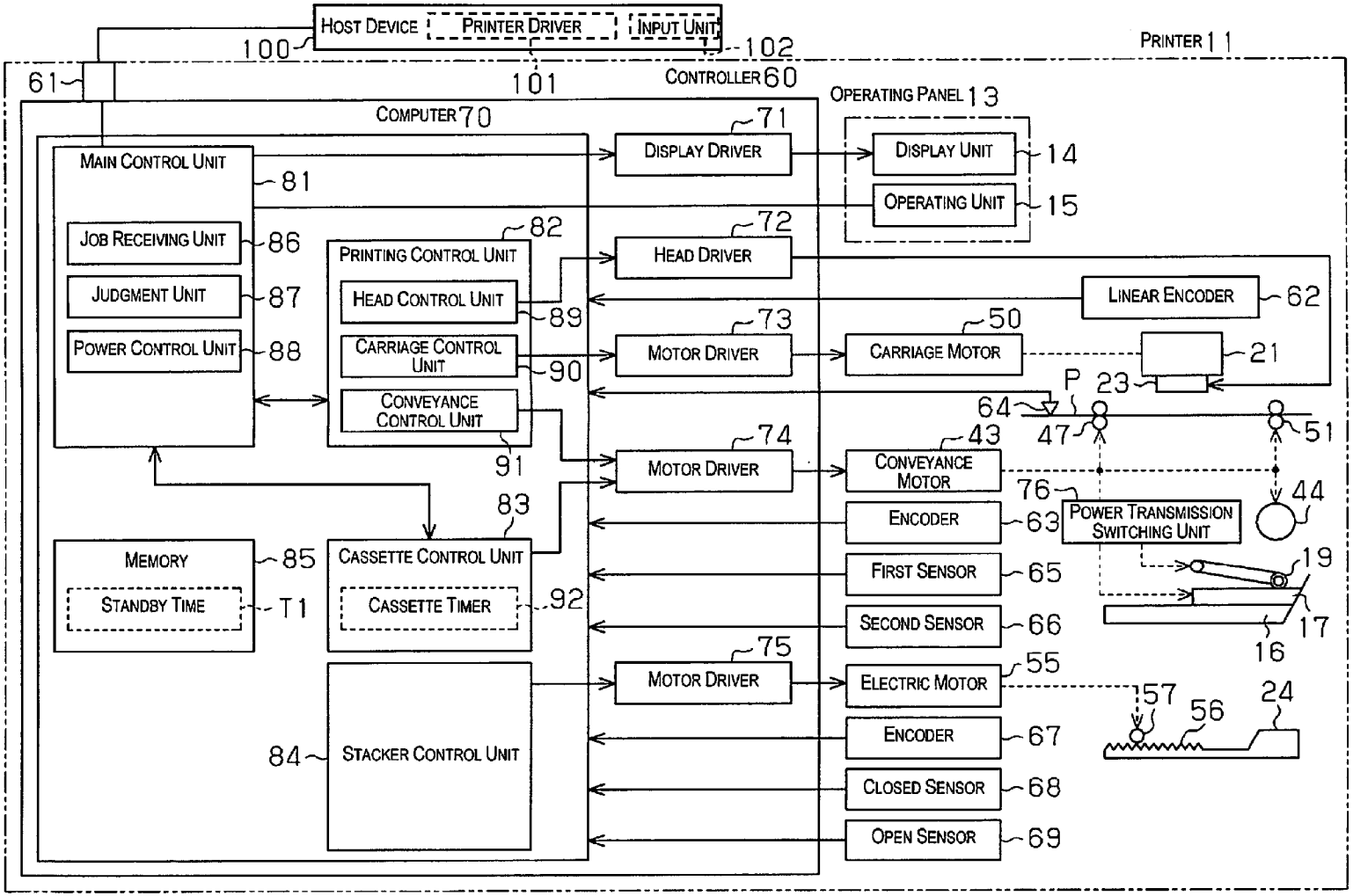
FIG. 7 is a block diagram showing an electrical configuration of the printer.

Also, as shown in FIG. 7, the computer 70 drives the electric motor 55 via the motor driver 75. When the electric motor 55 is driven to rotate in the normal direction, the pinion gear 56 rotates in the normal direction, and the stacker 24 is moved in the projecting direction via the engagement of this normal rotation pinion gear 57 and the rack 56. Meanwhile, when the electric motor 55 is driven in reverse, the stacker 24 is moved in the housing direction via the engagement of this reverse rotating pinion gear 57 and the rack 56.

An encoder 67 shown in FIG. 7 outputs to the computer 70 a detection pulse signal having a number of pulses proportional to the rotation amount of the electric motor 55. The closed sensor 68 is on in the state when the stacker 24 is in the closed position, and is off when the stacker 24 is not in the closed position. Also, the open sensor 69 is on in the state when the stacker 24 is in the maximum jutting volume open position, and is off when the stacker 24 is not in the open position.

The computer 70 is equipped with a counter (not illustrated) which uses the time that the stacker 24 is in the closed position as the origin point. The computer 70 increments the counter when the movement direction of the stacker 24 obtained by comparing the phase of two signals of different phases contained in the detection pulse signal from the encoder 67 is the projecting direction, and meanwhile, decrements the counter when the movement direction of the stacker 24 is the housing direction. In this way, the computer 70 grasps the position according to the actual jutting volume of the stacker 24 from the count value of this counter.

Figure 8:
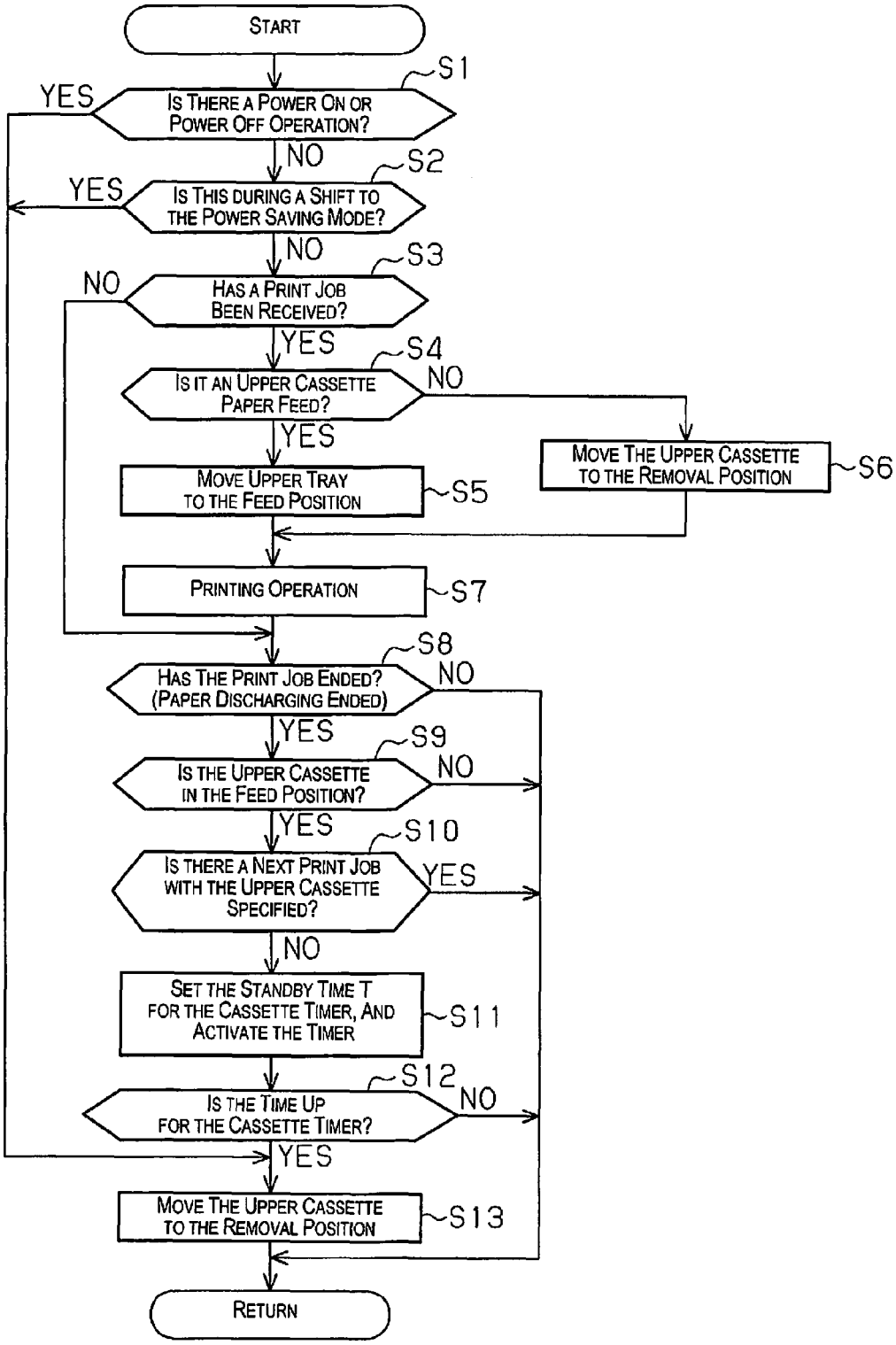
FIG. 8 is a flow chart showing a main control routine.
Figure 9:
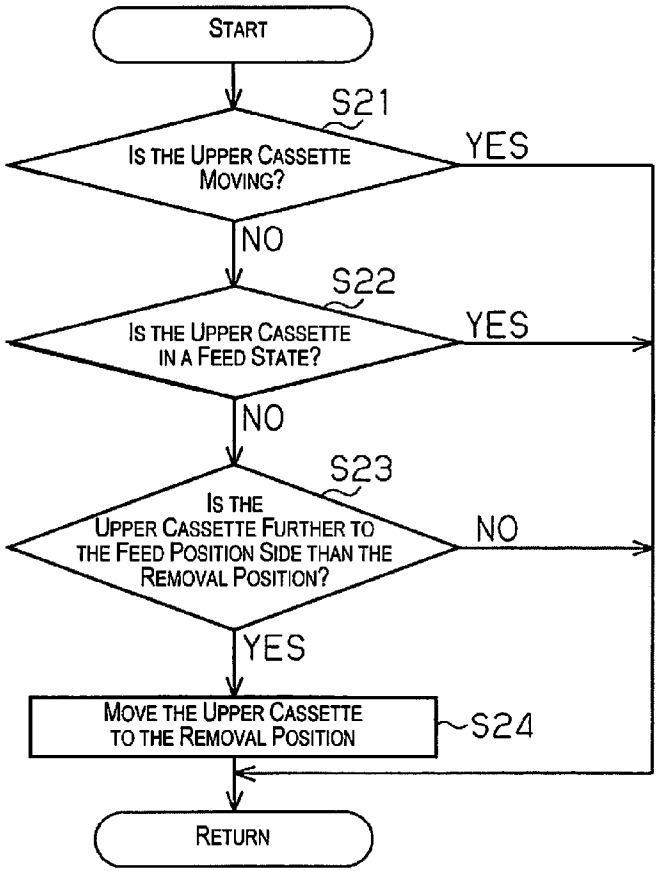
FIG. 9 is a flow chart showing the cassette control routine.

The computer 70 shown in FIG. 6 is constituted equipped, for example, with a CPU, ASIC (Application Specific IC (ICs for specific applications)), RAM, ROM, non-volatile memory and the like. Stored in the ROM or non-volatile memory are various types of programs including cassette control system programs shown in the flow charts in FIG. 8 and FIG. 9. FIG. 8 shows a main control routine for performing control relating to the printer 11 including cassette control for moving the upper cassette 17, and FIG. 9 shows a cassette control routine for moving the upper cassette 17 to the removal position when designated conditions are established other than the main control.

The computer 70 is equipped with a plurality of functional units shown in FIG. 6 consisting of software constructed by the CPU executing programs stored in the ROM or non-volatile memory. Specifically, as the plurality of functional units, the computer 70 is equipped with a main control unit 81, a printing control unit 82, a cassette control unit 83, and a stacker control unit 84 as one example of a control unit. Also, the computer 70 is equipped with a memory 85 for storing various types of data needed for various types of controls. Of course, each functional unit is not limited to being a software constitution using the computer 70, and it is also possible to have a hardware constitution such as electronic circuits (e.g. custom ICs) or the like, or a constitution using cooperation between software and hardware.

As shown in FIG. 7, the main control unit 81 is equipped with a job receiving unit 86, judgment unit 87, and a power control unit 88. The job receiving unit 86 receives print job data from the host device 100, and receives print job data for printing image data input to the printer 11 from a portable memory device such as a memory card, USB memory or the like connected to the printer 11. Paper size information is included in this print job data.

Also, the judgment unit 87 performs various judgment processes needed for controlling the printer 11.

Included in this judgment process are judgment processes necessary for performing cassette control for controlling the position of the upper cassette 17.

The power control unit 88 controls the supply of power to each unit within the printer 11. The printer 11 of this embodiment has a normal mode and a power saving mode as the modes relating to power.

After the printing operation ends, when left in a state with no operation of the operating unit 15 by the user, when a state with no operation by the printer 11 continues for a designated time, the power control unit 88 judges that power saving conditions are established, and shifts from normal mode to power saving mode. In the power saving mode, the supply of power is temporarily stopped to the printing system (recording head 23, motors 34, 43, 50 and the like), the display system (display unit 14 and the like), the sensor system (sensors 64, 65, and 66, and encoders 62, 63, and 67) and the like, and as an example, only the minimum necessary power is supplied to the CPU, the operating unit 15, the communication interface 61, and the like. Then, when an operation of the operating unit 15 by the user is detected, or printer operation instructions are received, the power control unit 88 shifts from the power saving mode to the normal mode, and again starts supplying power to the printing system, the display system, the sensor system and the like.

Also, the printing control unit 82 shown in FIG. 6 is equipped with a head control unit 89, a carriage control unit 90, and a conveyance control unit 91. The head control unit 89 controls the recording head 23 via the head driver 72 based on the print image data received from the main control unit 81, and performs control by having the recording head 23 spray ink drops.

The carriage control unit 90 controls driving of the carriage motor 50 via the motor driver 73, and controls movement of the carriage 21 in the main scanning direction X. Also, the carriage control unit 90 drives the carriage motor 50 for the switching operation of the power transmission switching unit 76 by the carriage 21. The carriage control unit 90 grasps the position of the main scanning direction X with the home position of the carriage 21 as the origin point, for example, from the calculation value calculated by the counter (not illustrated) of input pulses from the linear encoder 62.

The conveyance control unit 91 does drive control of the conveyance motor 43 via the motor driver 74, and controls feeding and conveyance of the paper P. The power of the conveyance motor 43 is transmitted to the feed drive roller 44, the conveyance drive roller 47, and the first roller 51 via the power transmission path including a gear train, and the paper P is fed and conveyed by the rollers 44, 47, and 51 rotating by that transmitted power. This conveyance motor 43 is also used for switching of the power transmission switching unit 76, and in a state with the carriage 21 pressing the lever, the conveyance motor 43 is driven by an amount of rotation correlating to the difference between the rotation position of the current switching position and that of the next switching position. For example, when the conveyance motor 43 is driven in a state with the power transmission switching unit 76 in the cassette switching position, the pickup roller 19 rotates and paper feed is performed.

The cassette control unit 83 shown in FIG. 6 moves the upper cassette 17 in the attaching and detaching direction by doing drive control of the conveyance motor 43 via the motor driver 74 in a state with the power transmission switching unit 76 in the cassette switching position. In a state with the upper cassette 17 in the removal position (state with the first sensor 65 on), by the cassette control unit 83 having the conveyance motor 43 rotate in the normal direction, the upper cassette 17 is moved from the removal position toward the feed position. At this time, when the upper cassette 17 separates from the removal position, the first sensor 65 switches from on to off. Furthermore, when the upper cassette 17 reaches the feed position, the second sensor 66 switches from off to on. When the second sensor 66 switches from off to on, by the cassette control unit 83 stopping driving of the conveyance motor 43, the upper cassette 17 stops at the feed position.

Also, by the cassette control unit 83 rotating the conveyance motor 43 in the reverse direction with the upper cassette 17 in a state in the feed position (state with the second sensor 66 on), the upper cassette 17 is moved from the feed position toward the removal position. At this time, when the upper cassette 17 separates from the feed position, the second sensor 66 switches from on to off. Furthermore, when the upper cassette 17 reaches the removal position, the first sensor 65 switches from off to on. When the first sensor 65 switches from off to on, by the cassette control unit 83 stopping driving of the conveyance motor 43, the upper cassette 17 stops at the removal position.

The cassette control unit 83 is equipped with a cassette timer 92. With this example, the cassette timer 92 performs timing of the time from the print job end time until the elapsed time reaches a first standby time T. The cassette timer 92 is constituted from a counter, for example. When the cassette control unit 83 receives from the printing control unit 82 notification to the effect that the paper discharging operation has ended after printing of an image based on the print job (e.g. final page) has ended, the first standby time T is set for the cassette timer 92, and the countdown starts. Then, when the time is up for this cassette timer 92, the cassette control unit 83 performs control to move the upper cassette 17 from the feed position to the removal position.

Selection of one of the lower cassette 16 and the upper cassette 17 to use for feeding is performed by the user activating the printer driver 101 of the host device 100 and operating the input unit 102 with the setting screen in a state displayed on the monitor, or by operating the operating unit 15 in a state with the setting screen displayed on the display unit 14 of the printer 11. This operation can be constituted by doing one selection specification from among the plurality of cassettes 16 and 17 on the setting screen, or when the specification information including at least the paper size is specified, can also be constituted by the printer driver 101 selecting one from among the cassettes 16 and 17 based on that specification information.

The stacker control unit 84 does drive control of the electric motor 55 based on instructions from the main control unit 81, and performs control to move the stacker 24 to the position instructed from among the closed position and the open position. The main control unit 81 of this embodiment performs instructions to move the stacker 24 from the closed position (housed state) to the open position (projecting position) for the stacker control unit 84 as printing preparation when power on is detected and a print job is received.

The stacker control unit 84 grasps the electric motor 55 rotation direction, specifically, the stacker 24 movement direction, from a comparison of the phases of two signals of different phases included in the detection pulse signal of the encoder 67. The stacker control unit 84 is equipped with a counter (not illustrated) that counts the pulse edge count of the detection pulse signals of the encoder 67, using as the origin point the time when the closed sensor 68 detects that the stacker 24 is in the closed position. The stacker control unit 84 increments the counter when the movement direction of the stacker 24 is the projecting direction, and meanwhile, decrements the counter when the movement direction of the stacker 24 is the housing direction. In this way, the stacker control unit 84 grasps the position of the stacker 24 based on the count value of the counter. With this embodiment for which the operating panel 13 and the stacker 24 are driven by a common power source, the stacker control unit 84 rotates the operating panel 13 from the closed position to the open position by moving the stacker 24 to the projecting direction when the power is on.

The memory 85 consists of RAM or non-volatile memory, for example, or can be constituted from both of these. Reference data needed for the control units 81 through 84 to perform various controls and the calculation results of the control units 81 through 84 are temporarily stored in the memory 85. With this example, data of the standby time T is stored in the memory 85.

For example, with a portion of the application program used with the host device 100, when performing multiple page printing, print job data is created for each page, so the printer receives a plurality of print job data (one page portion) intermittently. With this embodiment, after the print job using the upper cassette 17 as the paper feed source ends, after waiting for a standby time T, the operation of returning the upper cassette 17 from the feed position to the removal position is performed.

With this embodiment, during the operation of turning the power switch 15*a* on, during the operation of turning it off, and during the shift to the power saving mode, the upper cassette 17 is moved to the removal position. The reason for returning the upper cassette 17 to the removal position at this timing is because there is a relatively high possibility of the user performing refilling or replacing of the paper P2 in the upper cassette 17. For example, after the power on operation, there is a high possibility of the user refilling or replacing the paper for which printing is about to be performed, after the power off operation, there is a high possibility of the user refilling or replacing the paper in advance in the upper cassette 17 to prepare for printing for the next time the power is turned on, and during the power saving mode, there is a high possibility of the user refilling or replacing the paper for which printing is about to be performed.

Next the action of the printer 11 will be described. When the printer 11 is in a power on state, the computer 70 executes the main control routine shown in FIG. 8 and the cassette control routine shown in FIG. 9 which are executed at regularly designated times (e.g. a designated value within a range of 10 μsec. to 100 msec.).

The computer 70 executes the main control routine shown in FIG. 8 when the printer 11 power is on. This process relating to control of the upper cassette 17 for this main control is mainly executed when the main control unit 81 and the cassette control unit 83 within the computer 70 are performing various types of judgment processing and the like.

First, at step S1, a judgment is made of whether there is a power on or power off operation. Specifically, it is judged that there is a power on operation when the operation of the power switch 15*a* by the user is detected in a power off state of the printer 11, and it is judged that there is a power off operation when it is detected that there is a power switch 15*a* operation by the user when the printer 11 is in a power on state. When it is judged that there is a power on or power off operation, the process advances to step S13, and when it is not judged that there was that operation, the process advances to step S2.

Next, at step S2, a judgment is made of whether there is a shift to the power saving mode. Specifically, when a power mode shift notification notifying a shift to the power saving mode is received from the main control unit 81 which controls the power modes controlled by the power control unit 88, the judgment unit 87 judges this to be a time of a shift to the power saving mode, and when there is no power saving mode shift notification, it judges that it is not a time of a shift to the power saving mode. If it is the time of a shift to the power saving mode, the process advances to step S13, and if it is not the time of a shift to the power saving mode, it advances to step S3.

At step S3, a judgment is made of whether a print job has been received. When the job receiving unit 86 receives unexecuted print job data, and it is possible to execute that print job immediately, the main control unit 81 notifies the cassette control unit 83 that a job was received. When there is a job received notification, the cassette control unit 83 judges that a print job has been received, and when there is no job received notification, it judges that a print job has not been received. When a print job has been received, the process advances to step S4, and when a print job has not been received, the process advances to step S8.

At step S4, a judgment is made of whether this is upper cassette paper feed. Cassette specification information that specifies the used feed cassette is included in the print condition information in the print job data received by the job receiving unit 86. The cassette control unit 83 judges whether the feed cassette used for paper feeding is the upper cassette 17 based on the cassette specification information fetched from the main control unit 81.

When it is upper cassette paper feed, the process advances to step S5, and when it is not upper cassette paper feed, but rather is lower cassette paper feed, the process advances to step S6.

At step S5, the upper cassette moves to the feed position. Specifically, when the upper cassette 17 is not in the feed position, the cassette control unit 83 drives the conveyance motor 43 to rotate in the normal direction, and moves the upper cassette 17 from the removal position to the feed position. At this time, the upper cassette 17 pushes away the oscillating member 20 in the process of the upper cassette 17 moving to the feed position, and when it reaches the feed position, the pickup roller 19 abuts the top surface of the paper P2 within the upper cassette 17.

At step S6, the upper cassette moves to the removal position. Specifically, when the upper cassette 17 is not in the removal position, the cassette control unit 83 drives the conveyance motor 43 to rotate in the reverse direction, and the upper cassette 17 is moved from the feed position to the removal position. At this time, in the process of the upper cassette 17 moving to the removal position, the engagement of the oscillating member 20 with the upper cassette 17 is released, and the pickup roller 19 drops and abuts the top surface of the paper P1 within the lower cassette 16.

Next, at step S7, the printing operation is performed. First, the conveyance control unit 91 within the printing control unit 82 performs paper feed by driving the conveyance motor 43. After that, the carriage control unit 90 and the head control unit 89 are driven, and the recording operation is performed by performing one line of printing by spraying ink drops from the recording head 23 in the process of the carriage 21 moving in the main scanning direction X. Then, printing of an image on the paper P is performed by performing the recording operation and paper feed roughly alternately.

Next, at step S8, a judgment is made of whether a print job has ended. Here, a judgment is made of whether the paper discharging operation of the final page of the print job has ended. When the printing operation of the final page of the print job has ended, the printing control unit 82 performs the paper discharging operation of discharging the paper. At this time, the paper discharging operation is until the end of driving of the conveyance motor 43 by an amount of a designated rotation volume with the addition of a margin amount for the conveyance amount necessary for having no nipping of the paper P between the rollers 51 and 52 of the forwarding unit 39. The printing control unit 82 ends the print job based on ending of the paper discharging operation of the final page. When the print job ends, print job end notification is given from the printing control unit 82 to the cassette control unit 83. When there is a print job end notification, the cassette control unit 83 judges that the print job has ended, and if there is no print job end notification, judges that the print job has not ended. When the print job has ended, the process advances to step S9, and when the print job has not ended, this routine ends.

At step S9, a judgment is made of whether or not the upper cassette is in the feed position. Specifically, the cassette control unit 83 judges whether or not the upper cassette 17 is in the feed position based on each detection signal of the first sensor 65 and the second sensor 66. In more detail, when the first sensor 65 is off and the second sensor 66 is on, the upper cassette 17 is judged to be in the feed position. When the upper cassette is in the feed position, the process advances to step S10, and when the upper cassette is not in the feed position, this routine ends.

At step S10, a judgment is made of whether there is a next print job for which the upper cassette is specified. Specifically, when judging the presence of the next job and there is a next job, a judgment is made of whether the used feed cassette is the upper cassette based on the printing condition information.

When there is no next print job with the upper cassette specified, the process advances to step S11, and when there is a next print job with the upper cassette specified, this routine ends.

At step S11, the standby time T is set for the cassette timer 92, and the timer is activated. This cassette timer activation process is performed by the cassette control unit 83.

Next, at step S12, a judgment is made of whether the cassette timer 92 time is up. This judgment process is performed by the cassette control unit 83. When the standby time T time is up for the cassette timer 92, the process advances to step S13, and when the standby time T time is not up, this routine ends.

Next, at step S13, the upper cassette 17 is moved to the removal position. Specifically, the cassette control unit 83 does reverse drive of the conveyance motor 43 and moves the upper cassette 17 to the removal position. At this time, by stopping the drive of the conveyance motor 43 when the first sensor 65 turns on during reverse drive of the conveyance motor 43, the upper cassette 17 stops at the removal position. With this embodiment, also when a type of error is detected that requires the user to access the upper cassette 17, such as an out of paper error with which the paper P2 of the upper cassette 17 has run out, a paper size error or the like, control is performed to move the upper cassette 17 to the removal position.

For example, during the printing operation, even if the next print job is received it can't be executed, so this is regarded as a print job that can be executed not being received (negative judgment at S3), and since the cassette timer 92 is not activated and time up does not occur (negative judgment at S12), this routine ends.

Also, when the print job ends (affirmative judgment at S8), if the upper cassette 17 is in the feed position (affirmative judgment at S9), and there is no next job specifying the upper cassette 17 (negative judgment at S10), the standby time T is set for the cassette timer 92, and the timer is activated (S11). Then, when the standby time T from the print job end point has elapsed (affirmative judgment at S12), the upper cassette 17 is moved to the removal position.

Also, the upper cassette 17 is held in the feed position until the standby time T has elapsed, so even in the case of continuous printing setting one job per page for purposes of the mechanism of the application, despite it being multiple page printing, it is possible to avoid the problem of the upper cassette 17 being moved from the feed position to the removal position midway in this type of continuous printing.

Also, when the print job has ended (affirmative judgment at S8), if there is a next print job for which the upper cassette 17 has been specified at this time (affirmative judgment at S10), the upper cassette 17 is held in the feed position without being moved to the removal position. Because of this, it is possible to quickly start the next print job.

Also, after the print job ends, when the user operates the power switch 15*a* when the printer 11 power is on, it is judged that there was a power off operation (affirmative judgment at S1). At this time, the upper cassette 17 is promptly moved to the removal position (S13). Because of this, even when the printer 11 power is off, it is possible for the user to perform refilling or replacing of paper P2 in the upper cassette 17.

Also, when the user operates the printer 11 power switch 15*a* when the power is off, it is judged that there was a power on operation (affirmative judgment at S1). At this time, the upper cassette is promptly moved to the removal position (S 13). Because of this, when the user pushes in the upper cassette 17 for any reason when the printer 11 power is off, the upper cassette 17 is arranged in the removal position when the power is on, so for example immediately after activating the printer 11, it is possible for the user to perform refilling or replacing of the paper P2 in the upper cassette 17.

Furthermore, after the print job ends, when the printer 11 is shifted to the power save mode (affirmative judgment at S2), the upper cassette 17 is promptly moved to the removal position (S13). Because of this, even when the printer 11 is in the power save mode, the user is able to perform refilling or replacement of the paper P2 in the upper cassette 17.

Also, the computer 70 executes the cassette control routine at regularly designated time intervals. The computer 70 reads the cassette control routine program shown in FIG. 9 from the memory 85 and executes it.

First, at step S21, a judgment is made of whether or not the upper cassette is currently moving. When the upper cassette is not currently moving, the process advances to step S22, and if the upper cassette is currently moving, this routine ends.

At step S22, a judgment is made of whether or not the upper cassette is in the feed state. If the upper cassette is not in the feed state, the process advances to step S23, and if the upper cassette is in the feed state, this routine ends.

At step S23, a judgment is made of whether or not the upper cassette is further to the feed position side than the removal position. For example, when the control unit 83 positions the position of the upper cassette 17 on the movement path, grasped based on the count value of the counter, further to the feed position side than the removal position at which the first sensor 65 can be turned on, the upper cassette 17 is judged to be positioned further to the feed position side than the removal position.

Here, the reason that with the first sensor 65 off, this is not judged to be displaced further to the feed position than the removal position is because it is not possible to distinguish the state of the upper cassette 17 being removed. If the upper cassette 17 is further to the feed position side than the removal position, the process advances to step S24, and if the upper cassette 17 is not further to the feed position side than the removal position, this routine ends. It is also possible to use a constitution for which while the positional displacement volume of the upper cassette 17 from the removal position to the feed position side is small enough that there is no obstruction to removal of the upper cassette 17 (e.g. a designated value within a range of 5 to 20 mm or less), the upper cassette 17 is regarded as being in the removal position, and control to return the upper cassette 17 to the removal position is not performed.

At step S24, the upper cassette 17 is moved to the removal position. Specifically, the cassette control unit 83 drives the conveyance motor 43 to rotate in the reverse direction and moves the upper cassette 17 to the removal position, and when the first sensor 65 is turned on during driving of the conveyance motor 43 in the reverse direction, driving of the conveyance motor 43 is stopped. As a result, the upper cassette 17 stops at the removal position.

For example, when the user's hand that pushed the paper discharging stacker 24 to the housing position side contacts the upper cassette 17, there are cases when the upper cassette 17 is pushed to the position shown in FIG. 6 deeper than the removal position. In this case, when not in a feed state even when the upper cassette 17 is currently moving, when the upper cassette 17 is positioned further to the feed position side than the removal position, the upper cassette 17 is returned to the removal position.

With this printer 11, the upper cassette 17 is returned to the removal position when the print job ends, when the power is turned on, when the power is turned off, when shifting to the power saving mode, and when an error occurs requiring access to the upper cassette 17 (out of paper error, paper size error). These basically are performed only once when conditions are established, after which, handling cannot be done when the upper cassette 17 is mistakenly pushed and moved more to the depth side than the removal position. However, with this embodiment, in a case other than normal operation of the upper cassette 17, when there is successive detection of a state with it positioned further to the depth side than the removal position, the upper cassette 17 is returned to the removal position each time that kind of state is detected. Thus, the user is able to remove the upper cassette 17 that has returned to the removal position and perform refilling or replacement of the paper P2.

With the first embodiment described in detail above, the following effects can be obtained.

(1) The controller 60 drives the conveyance motor 43 and moves the upper cassette 17 to the removal position if the upper cassette 17 is positioned further to the feed position side than the removal position when the upper cassette 17 is not moving and when not in a feed state from the upper cassette 17. Thus, even if the user mistakenly pushes the upper cassette 17 in the attached position to inside the device main unit 12, control is used to return the upper cassette 17 to the removal position, so it is possible for the user to remove the upper cassette 17 from the removal position.

For example, with the technology of Unexamined Patent Publication No. 2005-330105, when the first tray is empty of paper and is moved to the removal position, if the first tray is mistakenly pushed to the feed position side, if the next print job is started and it is not after the first tray being empty is detected, the first tray is not returned to the removal position. However, with this embodiment, if it is detected that the upper cassette 17 is in a position displaced more to the feed position side than the removal position, the upper cassette 17 is returned to the removal position each time this detection is made, so when the user performs refilling or replacement of paper in the upper cassette 17, the frequency of when the upper cassette 17 is in the removal position is clearly higher than compared with the technology of Unexamined Patent Publication No. 2005-330105.

(2) The controller 60 waits until the standby time T has elapsed if there is no next print job after the current print job by the recording unit 38 ends in a state with the upper cassette 17 arranged in the feed position. Because of this, if there is a next print job that has the upper cassette 17 as the feed source within the standby time T, it is possible to start feeding paper from the upper cassette 17 immediately.

(3) During at least one of when the power on operation is detected, when the power off operation is detected, and when shifting to the power saving mode, control is used to move the upper cassette 17 to the removal position. When there is a high possibility of the paper P2 for these being refilled or replaced, the operation of arranging the upper cassette 17 in the removal position is done in advance, so when the power P2 is refilled or replaced in the upper cassette 17, the frequency of the upper cassette 17 being arranged in the removal position becomes high.

Second Embodiment

Next, the second embodiment will be described using FIG. 10. With this second embodiment, the cassette control routine differs from that of the first embodiment. The same code numbers are given for the same structures as the first embodiment, and their explanation will be omitted, and only parts that are specifically different will be described.

Figure 10:
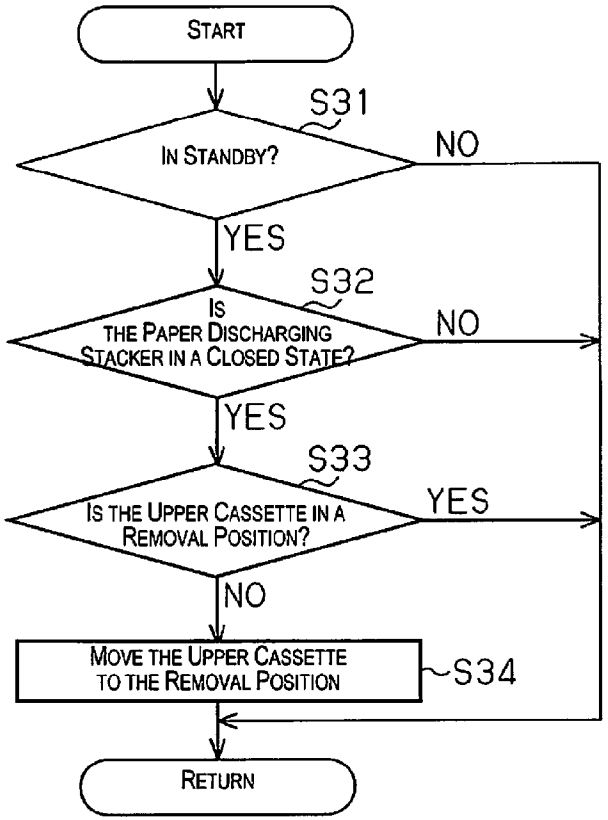
FIG. 10 is a flow chart showing a cassette control routine with a second embodiment.

When the printer 11 is in a power on state, the computer 70 executes the program of the cassette control routine shown in FIG. 10 read from the memory 85.

First, at step S31, a judgment is made of whether or not it is in standby. Here, being in standby means the period of waiting until the next print job is received after the end of the previous printing operation (print job), as long as it is not moving to the power saving mode. The main control unit 81 advances to step S32 if it is judged that the printer 11 is in standby, and ends this routine if it is judged that the printer 11 is not in standby.

At step S32, a judgment is made of whether or not the paper discharging stacker 24 is in a closed state. The stacker control unit 84 judges that the paper discharging stacker 24 is in a closed state when the closed sensor 68 is on, and judges that the paper discharging stacker 24 is not in a closed state when the closed sensor 68 is off. When the paper discharging stacker 24 is in a closed state, the process advances to step S33, and when the paper discharging stacker 24 is not in a closed state, this routine ends. The stacker control unit 84 grasps the position of the stacker 24 (jutting volume with the closed position as the origin point) from the count value of the counter, and it is also possible to judge that it is in a closed state based on the fact that it is further to the closed position side (housing position side) than a designated position for which its projecting length is clearly too short as the projecting length during printing. An example of the designated value is a value in a range from 1 mm to 5 cm.

At step S33, a judgment is made of whether or not the upper cassette is in the removal position. The cassette control unit 83 judges whether or not it is in the removal position based on the first sensor 65 being on.

When the first sensor 65 is off and it is not in the removal position, the cassette control unit 83 judges that the upper cassette 17 is in the removal position by performing the same judgment process as with step S23 in the second embodiment based on the position on the movement path of the upper cassette 17 grasped based on the count value of the counter. When it is judged that the upper cassette 17 is not in the removal position, the process advances to step S34, and when it is judged that the upper cassette 17 is in the removal position, this routine ends. The same as with step S23 of the second embodiment, it is also possible to have a judgment process whereby, based on the position on the movement path of the upper cassette 17 grasped based on the count value of the counter, the cassette control unit 83 regards the upper cassette 17 as being in the removal position when the positional displacement volume of the upper cassette 17 from the removal position to the feed position side is small enough that there is no obstruction to removal of the upper cassette 17.

At step S34, the upper cassette 17 is moved to the removal position. Specifically, the cassette control unit 83 drives the conveyance motor 43 to rotate in the reverse direction and moves the upper cassette 17 to the removal position. At this time, when the first sensor 65 is turned on during driving of the conveyance motor 43 in the reverse direction, by stopping the driving of the conveyance motor 43, the upper cassette 17 is stopped at the removal position.

For example, there are cases when the hand contacts the upper cassette 17 when the user pushes the paper discharging stacker 24 into the device main unit 12, and the upper cassette 17 ends up pushed to a position deeper than the removal position as shown in FIG. 6.

When in standby with no next print job to be implemented at this time (affirmative judgment at S31), it is permissible to move the upper cassette 17 to the removal position. Also, when the paper discharging stacker 24 is in a closed state (affirmative at S32), it is possible to judge that printing is not in progress and there is no plan for printing by the user. Then, when the printer 11 is in standby, and the paper discharging stacker 24 is in a closed state, if the upper cassette 17 is not in the removal position (negative judgment at S33), the cassette control unit 83 does drive control of the conveyance motor 43 and moves the upper cassette 17 to the removal position. Thus, after that, the user can pull out the upper cassette 17 in the removal position and perform refilling and replacing of the paper P2.

With the second embodiment described in detail above, the following effects can be obtained.

(4) Based on the detection results of the first sensor 65 and the second sensor 66, when the upper cassette 17 is positioned further to the feed position than the removal position, and the stacker 24 is positioned further to the housing position than the designated position, the controller 60 drives the conveyance motor 43 and moves the upper cassette 17 to the removal position. Specifically, when the stacker 24 is positioned further to the housing position side than the designated position and its jutting volume is small enough at a designated value or less to be regarded that printing will not be performed, control is used to move the upper cassette 17 to the removal position. Thus, even if the user mistakenly pushes the upper cassette 17 that is in the attached position into the device main unit 12, it is possible to remove the upper cassette 17 from the device main unit 12 from the removal position returned to by control.

(5) When the upper cassette 17 is positioned further to the feed position side than the removal position and the stacker 24 is in the housing position, the controller 60 drives the conveyance motor 43 and moves the upper cassette 17 to the removal position. Thus, when the stacker 24 is in the housing position and there is a possibility of assuming that printing will not be performed, the upper cassette 17 pushed into the device main unit 12 is returned to the removal position, so it is possible to remove the upper cassette 17 in the removal position relatively easily from the device main unit 12.

The embodiments noted above can be modified in the following kinds of modes.

It is also possible to use a constitution with which during printing with the lower cassette 16 as the feed source, if the upper cassette 17 is positioned further to the feed position side than the removal position, the drive unit is driven and the upper cassette 17 is moved to the removal position. In this case, it is also possible for the drive direction of the conveyance motor 43 when the upper cassette 17 is moved to the removal position to be made to be the same as the drive direction during feeding and conveying, and to connect the clutch of the power transmission switching unit 76 and moving the upper cassette 17 to the removal position by coupling the feed operation and the conveyance operation. Also, it is possible to use a constitution whereby the upper cassette 17 is driven by the force of an electric motor (an example of the drive unit) separate from the conveyance motor 43, and a constitution whereby during printing with the lower cassette 16 as the feed source, when it is detected that the upper cassette 17 is positioned displaced further to the feed position side than the removal position, the upper cassette 17 is moved to the removal position. With this constitution, during printing with the lower cassette 16 as the feed source, when refilling or replacing paper in the upper cassette 17, even if the user mistakenly pushes the stacker 24 into the device main unit 12, after that, the upper cassette 17 is quickly returned to the removal position, so it is possible to remove the upper cassette 17 and performing refilling or replacing of the paper P2. The process noted above can also be realized by executing the cassette control routine shown in FIG. 9 for example, during printing with the lower cassette 16 as the feed source. Specifically, during printing with the lower cassette 16 as the feed source, the upper cassette 17 is judged to not be moving (negative judgment at S21), and the upper cassette 17 is judged to not be in a feed state (negative judgment at S22). Then, when the upper cassette 17 is further to the feed position side than the removal position (affirmative judgment at S23), the upper cassette 17 is moved to the removal position (S24).

During the power saving mode, when at least the first sensor 65 is in an operating state for which detection is possible, the computer 70 can execute the following process. Changing to the process of S21 and S22 in FIG. 9 and the process of S31 and S32 in FIG. 10, the process is a judgment of whether or not in the power saving mode. Then, if in power saving mode, the judgment processes of S23 in FIG. 9 and S33 in FIG. 10 are performed. In other words, the cassette control unit 83 judges whether or not the position on the path of the upper cassette 17 grasped based on the count value of the counter is positioned further to the feed position side than the removal position detected by the first sensor 65. When the upper cassette 17 is at a position displaced further to the feed position side than the removal position, the computer 70 cancels the power saving mode using the power control unit 88. Next, the cassette control unit 83 drives the conveyance motor 43 and moves the upper cassette 17 to the removal position (correlating to FIG. 9, S24, and FIG. 10, S34).

It is also possible to use a constitution whereby the computer 70 executes the cassette control routine shown in FIG. 9 even during power saving mode. In this case, since it is during power saving mode, it is judged that the upper cassette 17 is not moving (negative judgment at S21), and judged that the upper cassette 17 is not in a feed state (negative judgment at S22). Then, when it is judged that the upper cassette 17 is further to the feed position side than the removal position (affirmative judgment at S23), the upper cassette 17 is moved to the removal position (S24). With these constitutions, during power saving mode, even if the user mistakenly pushes the upper cassette 17 into the device main unit 12, after that, the upper cassette 17 is quickly returned to the removal position, so it is possible to relatively easily remove the upper cassette 17 from the device main unit 12, and to refill or replace the paper P2 in the upper cassette 17.

It is also possible to provide one or a plurality of position displacement detection sensors capable of detecting that the upper cassette 17 is positioned in a middle range between the removal position and the feed position. Based on the position displacement detection sensor detecting that the upper cassette 17 is in the middle range, and the second sensor 66 detecting that the upper cassette 17 is in the feed position, it is possible to judge that the upper cassette 17 is displaced to a position further to the feed position than the removal position with S23 in FIG. 9 and S33 in FIG. 10.

It is also possible to have the standby time T timing start time be the printing end time (in other words, the paper discharging operation start time).

Also, the standby time T is not limited to being 2 seconds or less, for example, but as an example can also be a value in a range of from 1 second to 5 seconds.

It is also possible to have a constitution whereby among the standby time T elapsed times from when the power on operation is detected, when the power off operation is detected, when shifted to the power saving mode, and when the print job ends, the upper cassette 17 is moved to the removal position only during one, two, or three of these times. For example, it is possible to have it be only the standby time T elapsed time from when the print job ends.

It is also possible to have a constitution whereby when the user operates the operating buttons (not illustrated) on the operating panel 13, by the controller 60 driving the electric motor 55 in reverse based on those operating signals, the stacker 24 is housed from the open position to the closed position. It is also possible to provide a sensor capable of detecting the presence or absence of paper on the stacker 24, and after the print job ends, when it is detected that there is no next print job after waiting a fixed time, and the paper on the stacker 24 has been removed and has run out, the stacker 24 is controlled to be housed automatically. Even when the housing of the stacker 24 is electrically powered in this way, when the user mistakenly pushes the upper cassette 17 into the device main unit 12, it is possible to quickly return the upper cassette 17 to the removal position.

The number of feed cassettes is not limited to being two (two levels). It is also possible to constitute this equipped with three or more independent detachable feed cassettes in relation to the device main unit 12. In this case, an electric powered cassette moved by the power of an electric motor can be one or two of those. The feed cassette for which the length in the medium feed direction is shorter than that of the other feed cassettes is preferably mounted above the other feed cassettes.

It is also possible to arrange the cassette 17 for which the length in the medium sending direction is the relatively short side on the bottom, and the cassette for which the medium sending direction length is the relatively long side on the upper side. Also, when there are three layers or more of cassettes, it is possible to arrange one or a plurality of electric powered cassettes for which the length in the medium sending direction is shorter than the maximum length cassettes at the level between the highest level and the lowest level cassettes.

The power source constituting the drive unit is not limited to being a rotation type motor such as the conveyance motor 43, but can also be a linear motor. Also, the power source can be an electric power cylinder, a pneumatic cylinder, a hydraulic cylinder or the like.

The medium is not limited to being paper, and can also be a film made of resin, a metal foil, a metal film, a resin and metal composite film (laminate film), a woven material, a nonwoven fabric, a ceramic sheet or the like.

The recording device is not limited to being an ink jet type, and can also be a dot impact type, or a laser type. Furthermore, the recording device is not limited to being a serial printer, and can also be a line printer or a page printer. Also, the recording device is acceptable as long as it has at least a recording function (printing function) for forming images on the medium, and for example can be a composite device equipped with a printing function, a scanner function, and a copy function.

The lower cassette 16, the upper cassette 17, and the paper discharging stacker 24 can also be constituted as an integrated unit.

It is also possible to have a constitution whereby a paper discharging stacker is equipped on the downstream side end part in the conveyance direction Y of the paper on the upper cassette 17. In this case, the paper discharging stacker can be pulled manually, or the drive unit can be driven to pull it automatically.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording device comprising:

a first medium housing unit configured to house a medium;

a second medium housing unit configured to house the medium, a medium feed direction length of the second medium housing unit being shorter than that of the first medium housing unit;

a feed unit provided in common for the first medium housing unit and the second medium housing unit, the feed unit being configured to feed the medium from one of the first and second medium housing units, a drive unit configured to move the second medium housing unit between a feed position that allows the feed unit to feed, and a removal position that allows removal of the second medium housing unit from a device main unit, a conveyance unit configured to convey the medium fed by the feed unit, a recording unit configured to perform recording on conveyed medium based on a recording job;

a control unit configured to drive the drive unit to move the second medium housing unit to the removal position if the second medium housing unit is positioned further to a side of the feed position than the removal position when the second medium housing unit is not moving, and when the second medium housing unit is not in a feed state;

a stacker configured to stack the medium recorded by the recording unit and discharged, and move between a housing position housed in the device main unit and a projecting position projecting from the device main unit when stacking the medium, a first detection unit configured to detect that the second medium housing unit is in the removal position, and a second detection unit configured to detect that the stacker is further to a side of the housing position than a designated position that is a position for which a projecting length is shorter than that of the projecting position, wherein the control unit drives the drive unit and moves the second medium housing unit to the removal position based on detection results of the first detection unit and the second detection unit, when the second medium housing unit is positioned further to the side of the feed position than the removal position, and the stacker is positioned further to the side of the housing position than the designated position.

2. The recording device according to claim 1, wherein the second detection unit detects that the stacker is in the housing position, and the control unit drives the drive unit and moves the second medium housing unit to the removal position, when the second medium housing unit is positioned further to the side of the feed position than the removal position, and the stacker is in the housing position.

3. The recording device according to claim 2, wherein when there is no next recording job after a current recording job by the recording unit ends in a state with the second medium housing unit arranged in the feed position, the control unit waits until a standby time has elapsed, and when the standby time has elapsed, the control unit moves the second medium housing unit to the removal position.

4. The recording device according to claim 3, wherein the control unit moves the second medium housing unit to the removal position, during recording on the medium using the first medium housing unit as a feed source, if the second medium housing unit is positioned further to the side of the feed position than the removal position.

5. The recording device according to claim 4, wherein the control unit moves the second medium housing unit to the removal position during at least one of a time of power on operation detection, a time of power off operation detection, and a time when shifting to a power saving mode.

6. The recording device according to claim 5, wherein when in the power saving mode, when the second medium housing unit is detected to be positioned further to the side of the feed position than the removal position, the control unit cancels the power saving mode, drives the drive unit, and moves the second medium housing unit to the removal position.

7. A recording device according comprising:

a device main unit;

a first medium housing unit disposed in the device main unit, and configured to house a medium;

a second medium housing unit disposed in the device main unit, and configured to house the medium, a medium feed direction length of the second medium housing unit being shorter than that of the first medium housing unit, the second medium housing unit being detachable from the device main unit independently of detachment of the first medium housing unit from the device main unit;

a feed unit provided in common for the first medium housing unit and the second medium housing unit, the feed unit being configured to feed the medium from one of the first and second medium housing units, a drive unit configured to move the second medium housing unit between a feed position that allows the feed unit to feed, and a removal position that allows removal of the second medium housing unit from the device main unit, a conveyance unit configured to convey the medium fed by the feed unit, a recording unit configured to perform recording on conveyed medium based on a recording job;

a control unit configured to drive the drive unit to move the second medium housing unit to the removal position if the second medium housing unit is positioned further to a side of the feed position than the removal position when the second medium housing unit is not moving, and when the second medium housing unit is not in a feed state;

a stacker configured to stack the medium recorded by the recording unit and discharged, and move between a housing position housed in the device main unit and a projecting position projecting from the device main unit when stacking the medium;

a first detection unit configured to detect that the second medium housing unit is in the removal position; and a second detection unit configured to detect that the stacker is further to a side of the housing position than a designated position that is a position for which a projecting length is shorter than that of the projecting position, wherein the control unit drives the drive unit and moves the second medium housing unit to the removal position based on detection results of the first detection unit and the second detection unit, when the second medium housing unit is positioned further to the side of the feed position than the removal position, and the stacker is positioned further to the side of the housing position than the designated position.

8. The recording device according to claim 7, wherein the second detection unit detects that the stacker is in the housing position, and the control unit drives the drive unit and moves the second medium housing unit to the removal position, when the second medium housing unit is positioned further to the side of the feed position than the removal position, and the stacker is in the housing position.

9. The recording device according to claim 8, wherein when there is no next recording job after a current recording job by the recording unit ends in a state with the second medium housing unit arranged in the feed position, the control unit waits until a standby time has elapsed, and when the standby time has elapsed, the control unit moves the second medium housing unit to the removal position.

10. The recording device according to claim 9, wherein the control unit moves the second medium housing unit to the removal position, during recording on the medium using the first medium housing unit as a feed source, if the second medium housing unit is positioned further to the side of the feed position than the removal position.

11. The recording device according to claim 10, wherein the control unit moves the second medium housing unit to the removal position during at least one of a time of power on operation detection, a time of power off operation detection, and a time when shifting to a power saving mode.

12. The recording device according to claim 11, wherein when in the power saving mode, when the second medium housing unit is detected to be positioned further to the side of the feed position than the removal position, the control unit cancels the power saving mode, drives the drive unit, and moves the second medium housing unit to the removal position.

* * * * *